US005779545A

United States Patent [19]

Berg et al.

[11] Patent Number: 5,779,545

[45] Date of Patent: Jul. 14, 1998

[54] CENTRAL RANDOM NUMBER GENERATION FOR GAMING SYSTEM

[75] Inventors: David A. Berg; Robert A. Luciano, Jr.; Ali Saffari, all of Reno, Nev.

[73] Assignee: International Game Technology, Reno, Nev.

[21] Appl. No.: 711,847

[22] Filed: Sep. 10, 1996

[51] Int. Cl.[6] ..... A63F 9/24

[52] U.S. Cl. ..... 463/22

[58] Field of Search ..... 463/16, 22, 40, 463/41, 42, 43; 364/717.01, 717.05, 717.06

[56] References Cited

U.S. PATENT DOCUMENTS

| | | | |
|---|---|---|---|
| 4,095,795 | 6/1978 | Saxton et al. | 273/143 R |
| 4,238,127 | 12/1980 | Lucero et al. | 273/143 R |
| 4,339,134 | 7/1982 | Macheel | 463/12 |
| 4,448,419 | 5/1984 | Telnaes | 273/143 R |
| 4,527,798 | 7/1985 | Siekierski et al. | 273/86 R |
| 4,624,459 | 11/1986 | Kaufman | 273/143 R |
| 4,711,451 | 12/1987 | Pajak et al. | 273/143 R |
| 4,743,024 | 5/1988 | Helm et al. | 273/143 R |
| 4,858,932 | 8/1989 | Keane | 273/143 R |
| 5,042,809 | 8/1991 | Richardson | 273/138 A |
| 5,048,833 | 9/1991 | Lamle | 273/138 A |
| 5,102,137 | 4/1992 | Ekiert | 273/143 R |
| 5,106,091 | 4/1992 | Comito | 273/142 H |
| 5,154,421 | 10/1992 | Hamano | 273/143 R |
| 5,156,397 | 10/1992 | Valenza, Jr. | 463/25 |
| 5,199,710 | 4/1993 | Lamle | 273/149 R |
| 5,219,167 | 6/1993 | Hamano | 273/143 R |
| 5,251,898 | 10/1993 | Dickenson et al. | 273/143 R |
| 5,259,616 | 11/1993 | Bergmann | 273/138 A |
| 5,263,716 | 11/1993 | Smyth | 273/138 A |
| 5,326,104 | 7/1994 | Pease et al. | 273/138 A |
| 5,344,199 | 9/1994 | Carstens et al. | 273/138 A |
| 5,380,007 | 1/1995 | Travis et al. | 273/138 A |
| 5,380,008 | 1/1995 | Mathis et al. | 273/143 R |
| 5,505,449 | 4/1996 | Eberhardt et al. | 273/138 A |
| 5,511,784 | 4/1996 | Furry et al. | 273/143 R |
| 5,547,192 | 8/1996 | Ishibashi | 463/26 |
| 5,586,937 | 12/1996 | Menashe | 463/41 |
| 5,588,649 | 12/1996 | Blumberg et al. | 463/18 |
| 5,588,913 | 12/1996 | Hecht | 463/19 |

*Primary Examiner*—George Manuel
*Attorney, Agent, or Firm*—Sheridan Ross P.C.

[57] ABSTRACT

A gaming system is provided in which a central computer broadcasts a plurality of random number seeds serially for simultaneous receipt of each seed by a plurality of gaming terminals. Each gaming terminal uses the seed to generate a random number which determines the win/loss outcome. Two terminals configured to play the same game which receive the same random number seed will generate the same random number.

21 Claims, 5 Drawing Sheets

CENTRAL RANDOM NUMBER GENERATION FOR GAMING SYSTEM

The present invention relates to a gaming system in which win/loss determination for a particular gaming station is determined by information transmitted from a central computer to a plurality of gaming stations and in particular to a device in which users perceive their gaming decisions as influencing the outcome, even though the outcome is determined from a central computer.

BACKGROUND INFORMATION

A number of gaming systems include gaming stations or terminals, typically electronic terminals, although partially-mechanical terminals are also possible. Examples of electronic gaming terminals include electronic slot machines, electronic poker-playing machines, electronic keno machines and the like. In a typical situation, a plurality of such machines are provided and a user activates or initiates play on one or more of such machines by an action such as inserting a coin in a coin slot, inserting a credit card and/or smart card, making a selection by a push button, touch screen, etc., e.g. to make a wager. After play is initiated by a user, the gaming terminal determines whether the user has won or lost and outputs this information and/or makes a payoff to the user.

In some situations it is desired that the win/loss determination at given electronic terminals should be determined at a central location, such as a central computer coupled to two or more gaming terminals. Such central determination of win/loss may be mandated by governmental regulations or may be desired in order for a casino or other entity to maintain proper records, control the gaming, reduce or prevent cheating, etc.

In such a centrally-controlled operation, the perception of the user can be important. It is believed that in many situations, the maximum entertainment value of such gaming is achieved when players or users subjectively believe that their manner of play and/or decision to play/not play at a particular time and/or at a particular station influences the win/loss outcome. For example, players often want to feel that they have a better chance of winning if they play selectively at those places or those times when they "feel lucky." It is believed that the entertainment value of gaming is reduced if the players believe that, at the time the game is played, the decision as to whether they win or lose has already been made, and/or is centrally made. Similarly, players wish to believe that two persons playing the same game on two different machines will not necessarily achieve the same win/loss results.

Accordingly, it would be advantageous to provide a system in which the win/loss decision at any of a plurality of electronic terminals is determined by a central computer, (in the sense that, for two machines playing the same game, when they are played in an identical fashion, if one machine is a winner the other will also be a winner) and yet to increase entertainment value by providing players with a situation in which they perceive that the decision whether and when to play changes the win/loss outcome.

It would be further advantageous to provide a system in which some of the gaming terminals are configured for playing games different from those of other terminals. For example, some terminals may be configured as slot machine-type games while others may be configured as poker-type games. Some gaining terminals may be configured to simulate three-reel 22-position slot machines while others may be configured to simulate five-reel machines each with hundreds or thousands of reel positions (so-called "virtual reel" machines). It would be advantageous to provide this type of gaming environment while still achieving the centrally-generated random number feature, preferably without the need to duplicate elements of the central computer and/or communication links therewith.

SUMMARY OF THE INVENTION

According to the present invention, a central computer outputs random numbers or game outcome seeds (such as random number seeds) to a plurality of gaming terminals with the central computer outputting numerous game outcome seeds, one after another, preferably on a periodic basis wherein each seed which is broadcast can be received by a plurality of gaming terminals, preferably substantially simultaneously. Each gaming terminal can output a win or loss outcome based on any game outcome seed received from the central computer. Which of the seeds is used for making the win/loss determination at a given gaming terminal depends upon the time at which a user selects or activates that terminal, such as by placing a wager, pushing a button, making a touch screen selection, pulling a lever arm, and the like. In one embodiment, the central computer outputs game outcome seeds at a high frequency, preferably sufficiently rapidly that it would be unlikely for any two machines to be activated or selected at the same time. For example, if random number seeds are broadcast to all connected gaming terminals once every 250 milliseconds, any two gaming terminals would receive the same random number seed only if the players at those two machines activated the machines within 250 milliseconds of one another. Because this near-simultaneous activation would typically be a rare event, the entertainment value of the game will be enhanced because it will be the perception of the players that their decision as to whether and when to play a given machine affects the win/loss outcome (regardless of the fact that the ultimate win/loss determination for any given machine is made at a central computer which simultaneously controls win/loss decisions of a plurality of connected gaming terminals).

DETAILED DESCRIPTION OF THE PREFERRED EMBODIMENTS

Figure 1:
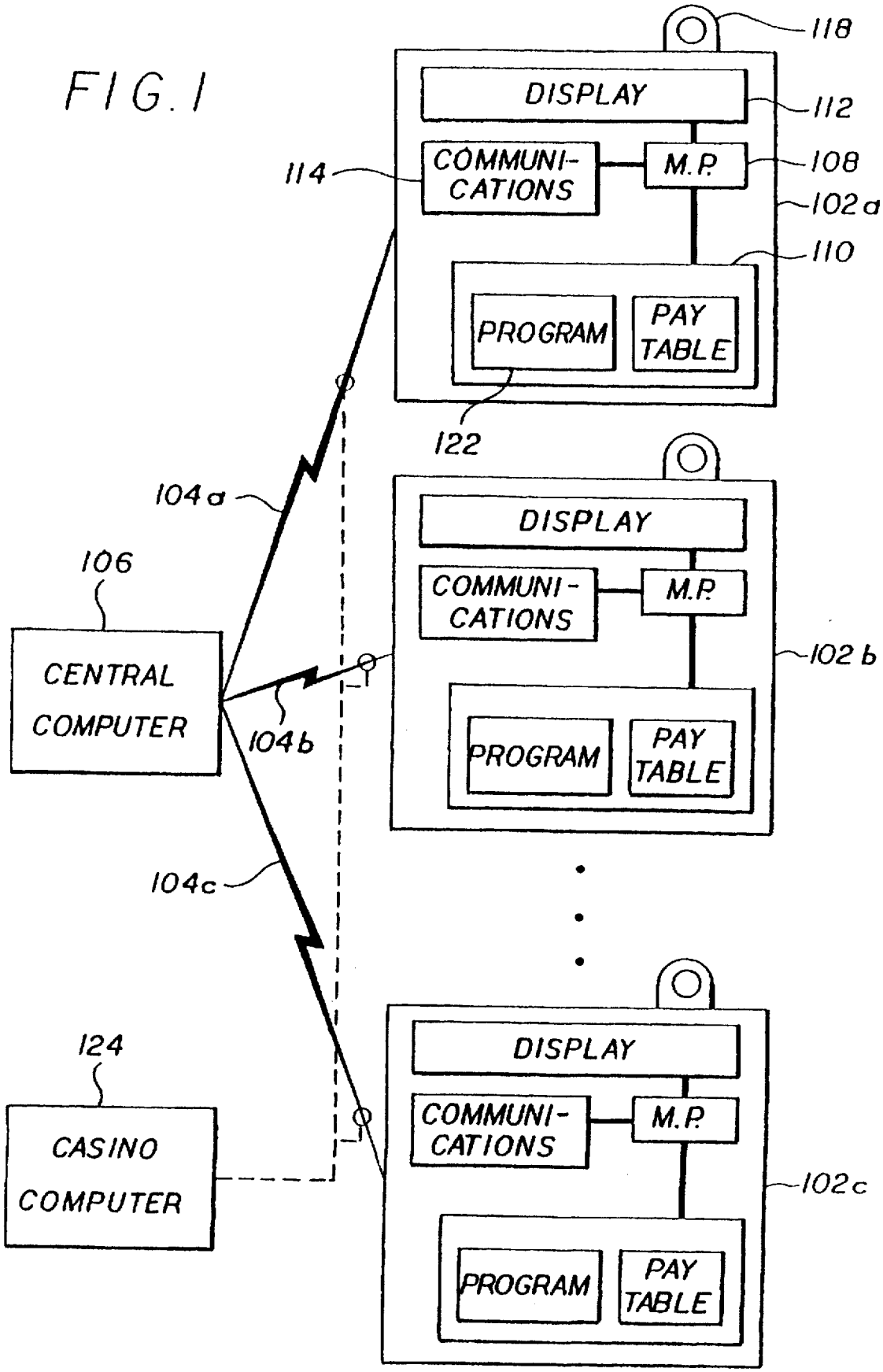
FIG. 1 is a block diagram of a gaming system according to one embodiment of the present invention.

As depicted in FIG. 1 according to one embodiment of the invention, each of a plurality of gaming terminals 102*a*, 102*b*, 102*c* is coupled via communication links 104*a*, 104*b*, 104*c* to a central computer 106. A number of types of gaming terminals can be used. In the depicted embodiment, each gaming terminal has a microprocessor 108 coupled to a memory 110, a display or other output device 112, and a communications facility 114. The terminal 102 also includes a device for permitting the user to use or activate the device such as by placing a wager, e.g., using coin slot 118 or other activation device such as a credit card slot, a bill verifier, a smart card receiving slot, a keyboard for receiving an identifier code, one or more buttons by which a user may initiate and/or control play which, if desired, may include touch screen ("virtual") buttons, e.g., presented on the display screen 112, and/or a slot machine-style lever (not shown). The microprocessor 108 operates in accordance with a program 122 stored in memory 110 (or stored in a separate memory such as an EEPROM or flash memory). Although it is possible to provide for all terminals which are coupled to the central computer 106 to be configured to play the same type of game, preferably, the terminals 102 and the programs 122 therein, are configured so that different terminals may be used for playing different types of games, e.g., such that some terminals may be used for playing a slot machine-style game, others may be used for playing a poker-style game, others may be used for playing a keno-style game, and the like. In one embodiment, some or all terminals may be configured so that they may be used for playing any of a plurality of different games, as selected by casino personnel and/or as selected by the user. In the depicted embodiment, the memory 110 of each terminal 102 stores pay table information, i.e., information which determines, for a given game result, whether that result represents a winning result or a losing result and, if a winning result, the type and/or amount of the payout for such win. If desired, different terminals 102 may be provided with different pay tables, even for terminals which are configured to play the same game. The general manner of constructing a program to control a microprocessor so as to permit a user to play various games and output results is well-known in the art and the manner of constructing the program to further implement the present invention will be understood by those of skill in the programming art after understanding the present disclosure.

The communications device 114 can be any of a plurality of devices known to those of skill in the art for receiving data communication and placing it in a format suitable for transmission to the microprocessor 108. In one embodiment, as described below, communication between the terminals 102 and the central computer 106 is two-way communication so that the communications device 114 also acts to transmit information from the microprocessor to the central computer 106.

The communication links 104 can be of various types, including coaxial cable, telephone cable, optical fiber, microwave communication links, infrared communication links, and the like. In one embodiment, a second computer 124 is coupled to the communication links 104*a*, 104*b*, 104*c* for monitoring the communications, e.g., for bookkeeping and/or security purposes, which may be a computer specific to a particular casino or other geographic location or a subdivision thereof.

Although it is possible, in one embodiment, to provide a system in which the central computer 106 outputs random numbers which are directly used by each of the gaming terminals 102, (if necessary, with translation to a format and/or range suitable for use with a particular game) this configuration can be difficult to implement in a situation in which different types of games use different ranges of random numbers or in which some games may use more or fewer random numbers than others. For example, for a standard poker game, the deal requires the device to generate five (different) random numbers in the range of one through 52 (each number corresponding to one of the cards in a deck) and the draw requires generation of a variable number of random numbers which are different from the original five. The system can be configured either to use a single seed to generate all 5–10 random numbers or can use two or more seeds, e.g. by using one seed for each generated random number (taking care not to repeat numbers already generated.) In a standard keno machine, the microprocessor should generate a plurality of (different) random numbers, e.g. in the range of one through 80. Typically, the player picks as many numbers as desired.

It would also be possible to provide several systems, each with a central random number generator and coupled terminals, e.g. with each system configured to play a different game, albeit at the cost of requiring more apparatus than might otherwise be needed.

In one embodiment one central computer 106 outputs game outcome "seeds" which are then used by the microprocessors 108 in each of the connected terminals to generate a random number which is appropriate for the particular game being played at that terminal. Transmission of game outcome seeds, (typically, a random number seed) rather than transmitting random numbers which are directly used by the gaming terminals, is believed to reduce the computational load on the central computer (which may additionally have security, bookkeeping or other duties) and the load on the communications links, albeit at the cost of additional computing at the gaming terminals.

Preferably, the relationship between the game outcome seed and the generated random number is deterministic in the sense that for any two gaming terminals which are configured for playing the same game, the random numbers generated by those two terminals will be the same if they are based upon the same seed, even though the microprocessors 108 in the two terminals are operating independently from one another. Procedures for generating a random number in a particular numerical range from a given random number seed are well known to those of skill in the programming art. The random number seed which is generated by the central computer 106 should have a range large enough to produce results in the gaming terminals which appear, at least subjectively to the users, to be random, but small enough to permit effective communication at a high frequency. In one embodiment, the random number seed is an 8-bit binary number (and thus is itself a random number). In one embodiment, the central system provides an associated identification tag for each seed that is transmitted, e.g. so that the seed can be identified and traced back later to check for or analyze instances of cheating.

Figure 2:
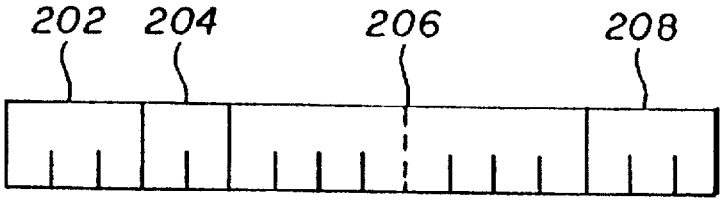
FIG. 2 depicts a format for transmitting a random number seed according to an embodiment of the present invention.

FIG. 2 depicts one format for transmitting a random number seed although other formats can be used, as will be apparent to those of skill in the art. The random number seed is embedded in a 16-bit-wide field. In the depicted embodiment, the first three bits 202 signify an address, with 000 indicating a global address. The next two bits 204 are a function code indicating what type of communication the present 16-bit field represents. Preferably, at least one of the codes identifies this communication as a random number seed broadcast. The next eight bits 206 are the random number seed, in one embodiment, divided into first and second 4-bit nibbles, each organized with the least significant bit first. The final three bit field 208 is an error detection/correction field such as a cyclical redundancy check (CRC) field or a parity field. In one embodiment, the data is encrypted by the central computer before transmitting over the links 104*a*, 104*b*, 104*c* and decrypted in the terminals 102 (and, optionally, the casino computer 124) according to decryption keys which may be downloaded, from time to time, or otherwise changed. Encryption assists in preventing cheating.

In one embodiment, the central computer may communicate information other than random number seeds. For example, the computer may poll various gaming terminals or other devices to verify status, retrieve stored data, detect signs of cheating or other irregularities and the like. Although a polling system is described, it is also possible to use an interrupt system, as will be apparent to those of skill in the art.

In one embodiment, the central computer may be configured to detect cheating by receiving status verification data from gaming terminals. In one embodiment a gaming terminal, in response to a poll, sends an electronic signature characteristic of its EEPROM or other component which the central computer can compare to the known correct or authorized signature stored in memory. In another embodiment, the central computer receives reports of wins or payouts from the various terminals. Since the central computer 106 can, if desired, keep a record of which random number seeds were generated at which times (and, if desired, associated identification tags) and can, if desired, keep information necessary to replicate the operation of any connected terminal, it is possible to use the central computer to determine, in response to a reported win, whether there was a random number seed broadcast to that terminal that should have resulted in a win.

The amount of spacing between sequentially-transmitted random number seeds depends on various factors. Although it is possible to configure a gaming terminal to wait for the first seed (or $n^{th}$ seed) which is received after a coin drop (or other activation), in one embodiment it is preferred to avoid the wait by buffering or storing received seed and using the last seed (or $n^{th}$-to-last seed) received before activation of play on the terminal. In either case, the smaller the period between successive seeds, the less likely it is that two machines which are activated at about the same time will use the same random number seed. This is believed to provide for greater entertainment value and also to lessen the likelihood that a large number of terminals will receive the same top-winning random number seed and thus output a top-winning payout. Thus, if a new seed is transmitted every 250 milliseconds, two machines would have to be activated within 250 milliseconds of each other in order to use the same random number. On the other hand, more rapid generation of random number seeds places a greater computational burden on both the central computer 106 and the gaming terminals. Preferably, the spacing between successive random number seeds is sufficiently small to substantially prevent a single player from consistently activating two or more machines so as to use the same random number seed. In one embodiment, random number seeds are broadcast by the central computer 106 such that successive seeds are spaced apart by about one second or less, preferably by about 500 milliseconds or less, more preferably by about 350 milliseconds or less, and even more preferably by about 250 milliseconds or less. In one embodiment, if there are two or more identical winning outcomes (e.g., if two or more systems get the same seed), the multiple winners will share in a pooled prize.

Figure 3:
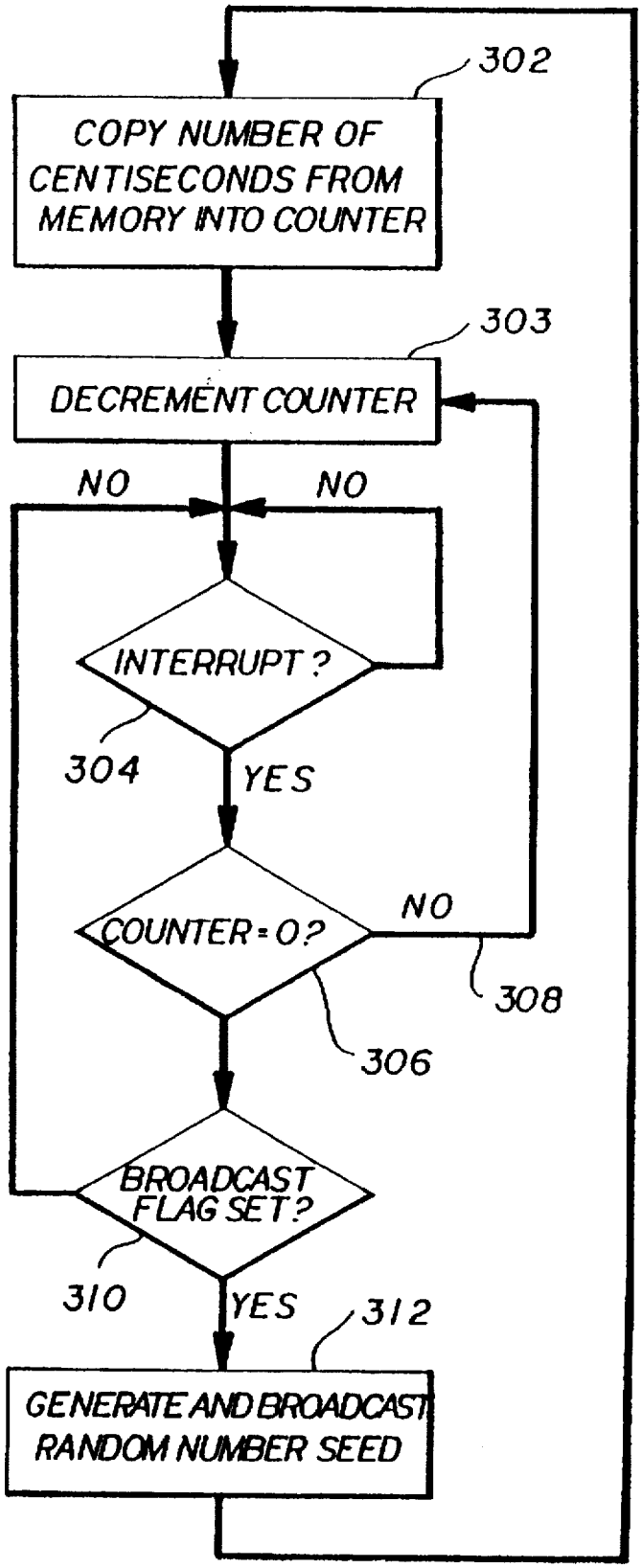
FIG. 3 is a flow chart of a process for generating and broadcasting periodic random numbers according to an embodiment of the present invention.

A number of methods can be used for generating periodic timing signals for broadcast of random number seeds. The embodiment depicted in FIG. 3 makes use of a periodic interrupt cycle of 10 milliseconds (1 centisecond). In this embodiment, the number of centiseconds to expire between broadcasts is stored in memory. When a period of 250 milliseconds is desired, the value stored in memory will thus be 25. At the beginning of the procedure this value (e.g. 25) is copied from memory into a counter 302. The counter is decremented 303 and then the computer waits until an interrupt occurs 304. After the interrupt has occurred (i.e. after the passage of 10 milliseconds) it is determined whether the current value of the counter is zero 306. If not 308 the procedure returns to the "decrement counter" step 303. If the counter has been decremented to zero it is determined whether a broadcast flag has been set 310. This permits using a flag to delay broadcast of a random number seed, e.g. if the central computer and/or communication link is engaged in a different, higher priority task. If the broadcast flag is not set, the computer returns to wait for the next interrupt cycle 304. Once the broadcast flag is set, the computer will generate a random number seed (using any of the plurality of random generation procedures well known to those of skill in the programming art) and broadcast the seed 312, properly formatted (FIG. 2) over the communication links 104.

Figure 4:
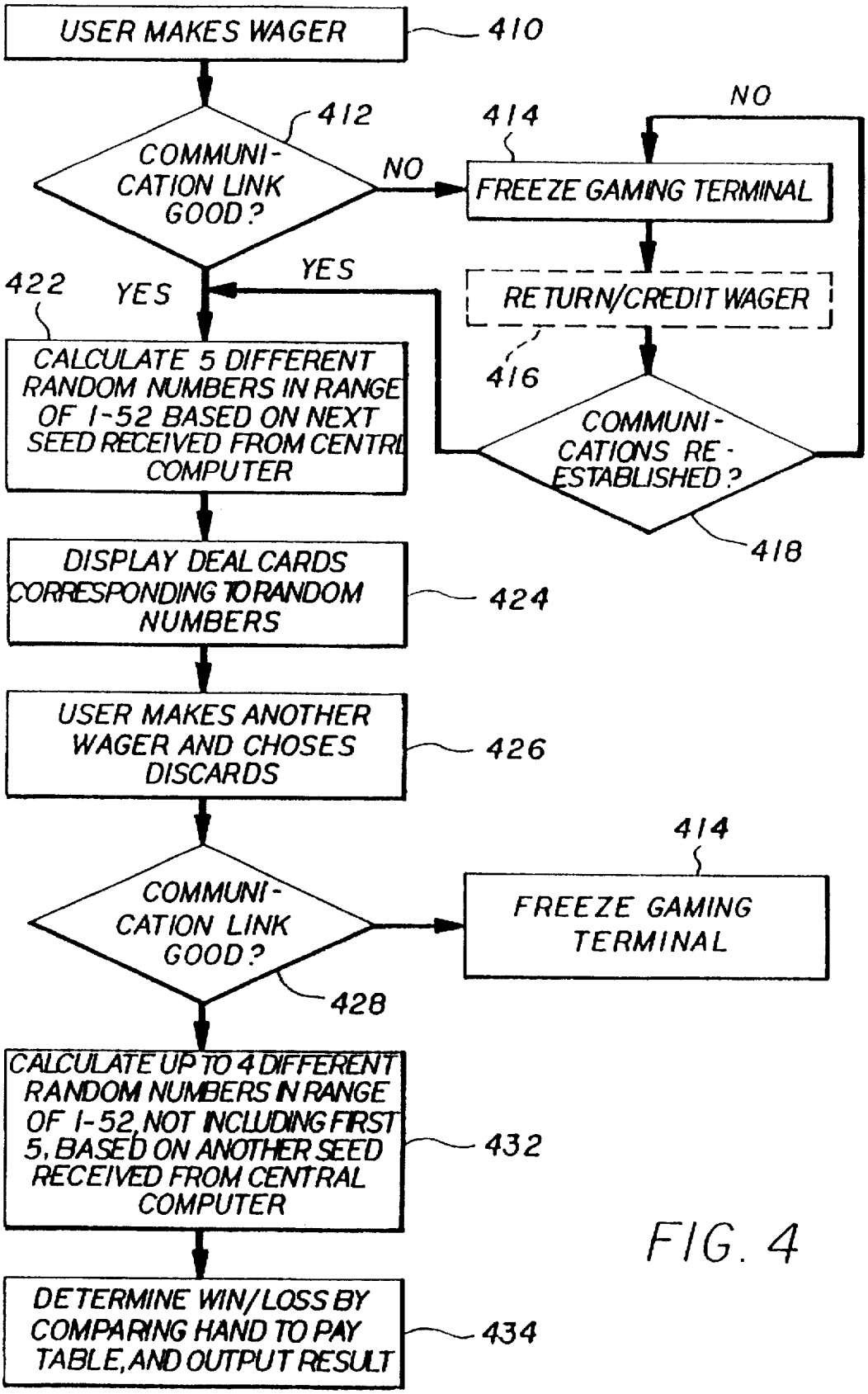
FIG. 4 is a flow chart for using centrally generated random number seeds received from a central computer for playing a poker game according to an embodiment of the present invention.

FIG. 4 depicts a manner of using a random number seed in connection with a poker-type game. The procedure begins with activation of play in response to a user input 410 (such as a coin drop, a real or virtual button push, etc.). The gaming terminal microprocessor then determines 412 whether the communication link with the central computer appears to be currently active i.e. whether a random number seed has been received within the last 250 milliseconds. If the link appears to be lost, an appropriate "link lost" procedure will be implemented. Various options are available for this procedure. The microprocessor may freeze the operation of the terminal 414 preventing any further input or output, may, if desired, return money, or credit the account of the user 416 (or alternately may retain the wager), may notify the central computer and/or the casino, may display a signal light, generate a sound, and the like. In one embodiment, the microprocessor continues to monitor for re-establishment of the link 418 (optionally within a predetermined period) and upon regaining the link, automatically continues play.

If it appears that the link is still good, the microprocessor uses the next-received random number seed (or, if desired, a previously-received random number seed, such as the next-to-most-recently received seed, a seed randomly selected from among the ten most recently received seeds or the like) and, on the basis of this seed, generates five different random numbers 422 in the range of 1 through 52. The microprocessor then displays images of playing cards 424 which correspond to the five random numbers that were generated. The microprocessor waits for a period of time to permit the user to select which, if any, of the cards to discard, optionally permitting another wager 426. Following the discard selection, the microprocessor must select draw cards to replace the discarded cards. These draw cards will be selected by generating between one and four random numbers (depending on the number of cards discarded) in the range of 1–52, but not including cards previously included in the deal. Although it would be possible to use the same seed that was used in connection with the deal, in one embodiment it is preferred to use a different seed for the random number generation for draw cards. It is believed that using a second random number both increases the perception of user choice (and thus increases the entertainment value)

and also provides for a smaller likelihood of cheating. Accordingly, the device once again determines whether the communication link is still active 428. If the communication link is not active, the procedure branches to a link loss operation which may be identical to the first link loss operation or may be different for the deal and draw situations. If there has not been a loss of communication, the microprocessor uses the next random number seed received from the central computer to generate random numbers corresponding to draw cards to replace the discarded cards 432. The microprocessor then compares the five-card hand with a pay table to determine whether the hand is sufficiently good to justify a win or payoff 434. If there is a win determination, the microprocessor may take various actions such as crediting the account of the user, making an appropriate entry in a user's smart card, controlling a pay-out hopper to place coins into a pay-out tray, placing an appropriate pay-out display on the display screen, generating sounds, lights, and the like. The microprocessor then returns to the original state.

Figure 5:
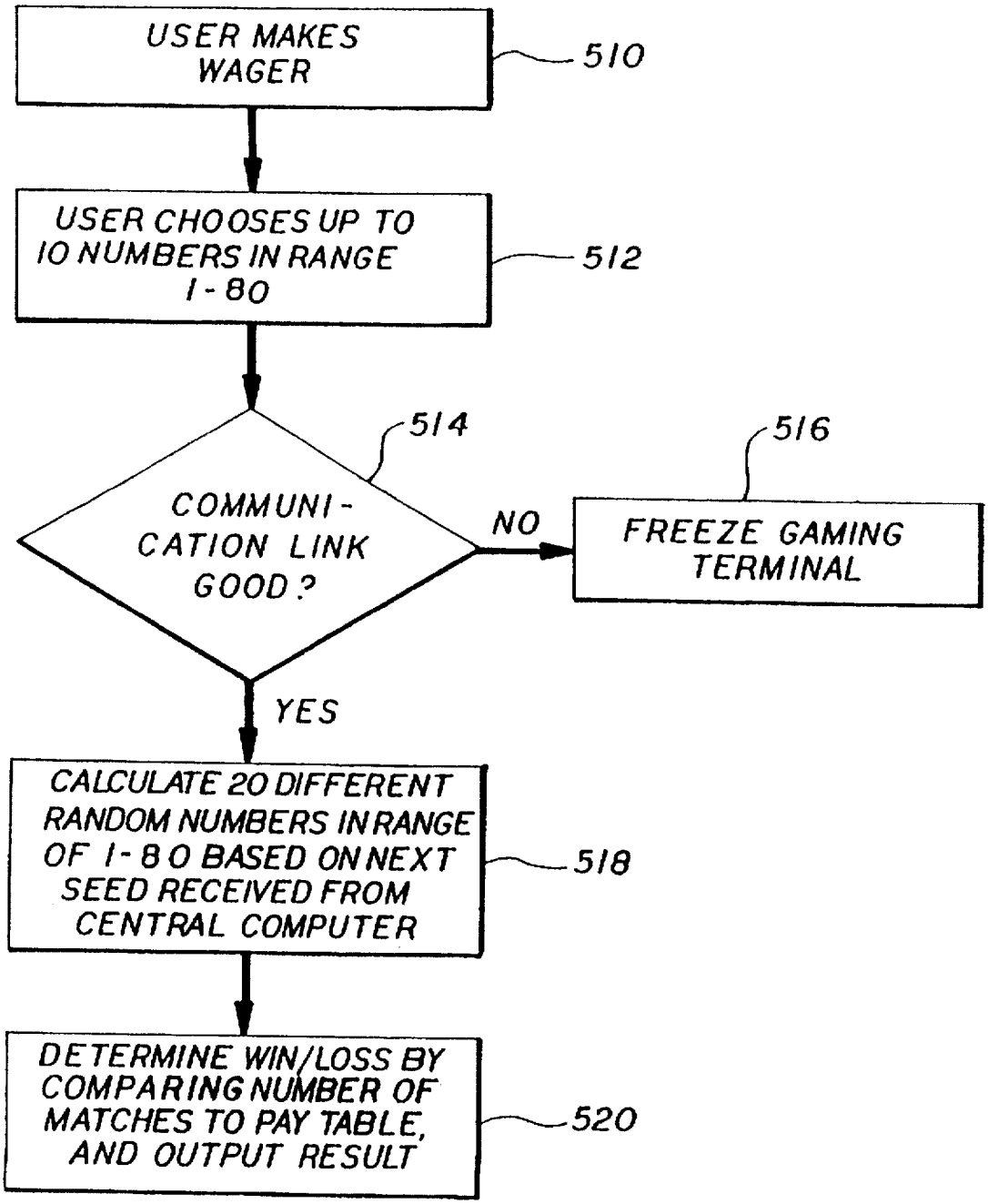
FIG. 5 is a flow chart of a process for using a centrally generated random number seed for playing a keno game according to an embodiment of the present invention.

FIG. 5 is a flowchart similar in some respects, to the flowchart FIG. 4 but showing a procedure for playing a Keno game. In FIG. 5, after the user initiates play e.g. by making a wager 510, and choosing up to ten numbers in the range 1–80 512, the microprocessor checks to see whether the communication link is good 514. If not, the microprocessor institutes a "link lost" procedure which may include, e.g. freezing the gaming terminal 516 (i.e. refusing to accept further user input or to provide normal gaming output.) If the communication link is good (or if a lost link is recovered) the microprocessor uses the next seed received from the central computer to calculate twenty different random numbers in the range of 1–80 518. The microprocessor then determines wins and losses by comparing the number of matches between the user-selected numbers and the generated numbers to a pay table and outputs the results e.g. by reporting to the central computer and/or casino computer, placing an appropriate indication on the display screen, crediting the user's account or smart card, outputting coins or other pay-out and the like 520.

Figure 6:
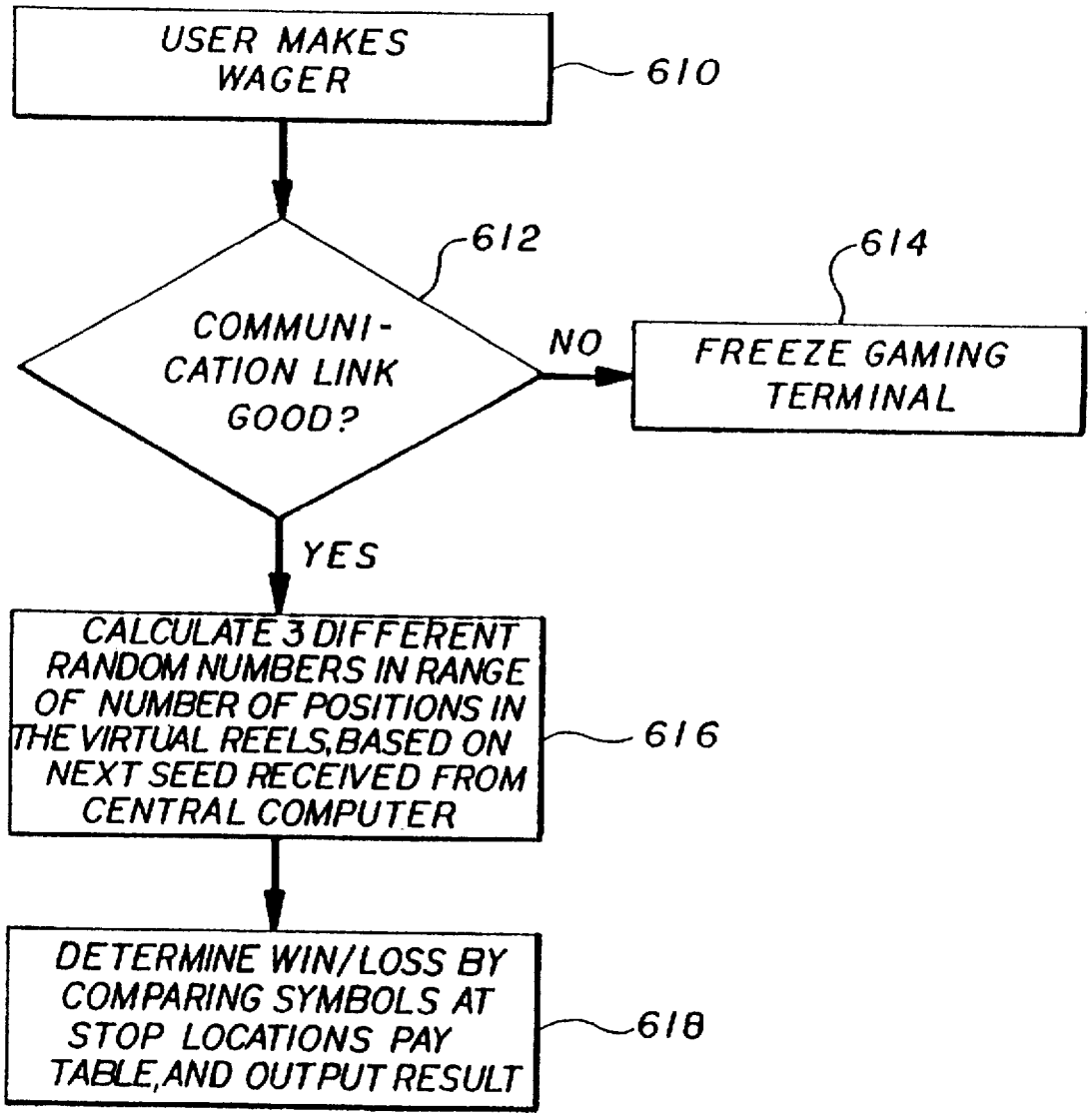
FIG. 6 is a flow chart of a process for using a centrally generated random number seed for playing a slot machine game according to an embodiment of the present invention.

FIG. 6 is a flowchart of a procedure similar to that depicted in FIG. 5 but used for playing a slot machine type game. In the embodiment of FIG. 6 after the user makes a wager 610 such as by inserting a coin in a coin slot, pushing a real or a virtual button, pulling a lever, and the like, the microprocessor determines whether the communication link is good 612. If the communication link is not good, the microprocessor institutes a "link lost" procedure which may include, e.g. freezing the gaming terminal 614. If the communication link is good and/or if a lost communication link is reestablished, the microprocessor uses the next seed received from the central computer to calculate three different random numbers 616. Each of the random numbers is in a range corresponding to the number of stop positions on the three slot machine reels (or virtual reels, in the case of an electronic slot machine). If there are more than three reels or virtual reels, more than three numbers will be generated. The microprocessor then displays the results such as by displaying a symbol associated with the stop position for each reel (or virtual reel) and determines wins/loss by comparing the symbols at the stop positions with the pay table and outputs the results 618. It should be recognized that other schemes for selecting reel stop positions using a random number may be apparent to one of skill in the art.

In light of the above description number of advantages the present invention can be seen. The invention provides for central generation of win/loss information for a plurality of gaming terminals, but still preserves entertainment value by providing the perception that selection of when and whether to play a particular terminal affects the outcome. Communication of the information is provided in such a way as to permit accounting, taking appropriate action when a communication link is lost, and guarding against cheating.

A number of variations and modifications of the invention can be used. Some aspects of the invention can used without using other aspects. For example, it is possible to provide rapid spaced-apart random number seeds without making transmission of the seeds strictly periodic. It is possible to transmit different seeds to different groups of terminals. It is possible to transmit different information at the same time by multiplexing messages over communication links. It is possible to provide for remote gaming such as gaming using a dial-up terminal, communication over a global communication systems such as the Internet, communicating over telephone lines, television or other broadcast cable lines.

Although the invention has been described by way of a preferred embodiment in certain variations and modifications other variations can also be used, the invention being defined by the following claims:

What is claimed is:

1. A method for using a gaming system comprising:

providing a central computer;

coupling said central computer to at least one gaming terminal having a terminal processor configured for playing a game;

transmitting a series of game outcome seeds from said central computer substantially simultaneously to each gaming terminal;

initiating play at a first of said plurality of gaming terminals by calculating a first random number in a range selected for said game of said first gaming terminal, in response to a user action occurring at a first time, wherein said first random number is based on a game outcome seed received at said first gaming terminal from said central computer at said first time;

initiating play at a second of said plurality of gaming terminals by calculating a second random number in a range selected for said game at said gaming terminal, in response to a user action occurring at a second time, wherein said second random number is based on a game outcome seed received at said second gaming terminal from said central computer at said second time; and wherein said terminal processors are configured such that when said first and second terminals are configured for playing an identical game when play is initiated on both at predetermined times and when said first and second game outcome seeds are identical, said first and second random numbers calculated by the terminal processors of said first and second gaming terminals will be identical.

2. A method as claimed in claim 1 wherein said period is less than about 250 milliseconds.

3. A method as claimed in claim 1 wherein said central computer is coupled to a plurality of gaming terminals.

4. The method as claimed in claim 3 wherein said games of at least two of said plurality of gaming terminals are different.

5. A method as claimed in claim 1 wherein said transmitting of a series of game outcome seeds occurring at predetermined times.

6. A method as claimed in claim 1 wherein said transmitting game outcome seeds are spaced apart by at least a predetermined period.

7. A method as claimed in claim 1 wherein said step of transmitting over a communication link selected from among coaxial, telephone cable, fiber optics, microwave links, and infrared links.

8. A method as claimed in claim 7 wherein said communication link is used for transmitting a second type of information different from said random number seed.

9. A method as claimed in claim 8 wherein said second type of communication includes a polling signal transmitted from said central computer to at least a first of said gaming terminals.

10. A method as claimed in claim 8 wherein said second type of communication link includes information sent from said gaming terminal to said central computer.

11. A method as claimed in claim 1 wherein said game of at least one of said plurality of gaming terminals uses first and second random numbers based on first and second random number seeds received at said gaming terminal at first and second different times.

12. A method as claimed in claim 1 further comprising detecting loss of a communication link between said central computer and said gaming terminal.

13. A method as claimed in claim 12 further comprising suspending game play in response to said step of detecting.

14. A method as claimed in claim 12 further comprising returning or crediting wagers placed but not yet played in response to said detecting.

15. Apparatus for a gaming system comprising:

a central computer;

a plurality of gaming terminals coupled to said central computer by communication links, each terminal having a terminal processor configured for playing a game;

said central computer being programmed to transmit a series of random number seeds from said central computer substantially simultaneously to each of said plurality of gaming terminals, said transmitting of each of said random number seeds being spaced apart by at least a predetermined period;

said terminal processor of each gaming terminal being programmed to calculate at least a first random number in a range selected for said game of said gaming terminal in response to a user action based on a random number seed received from said central computer;

wherein said terminal processors are configured such that when first and second terminals are configured for playing identical games and when said first and second terminals receive identical random number seeds identical first and second random numbers will be calculated by the terminal processors of said first and second gaming terminals.

16. Apparatus for using a gaming system comprising:

a central computer;

a plurality of gaming terminal means, each terminal means having a terminal processor means configured for playing a game;

means for coupling said central computer to said plurality of said gaming terminals;

means for transmitting a series of random number seeds from said central computer substantially simultaneously to each of said plurality of gaming terminals, said transmitting of each of said random number seeds being spaced apart by at least a predetermined period;

means, in a first of said gaming terminals, for initiating play by calculating a first random number in a range selected for said game of said first gaming terminal, in response to a user action occurring at a first time, wherein said first random number is based on a random number seed received at said first gaming terminal from said central computer at said first time;

means in a second of said plurality of gaming terminals, for initiating play by calculating a second random number in a range selected for said game at said gaming terminal, in response to a user action occurring at a second time, wherein said second random number is based on a random number seed received at said second gaming terminal from said central computer at said second time;

wherein said terminal processors are configured such that when such first and second terminals are configured for playing identical games and when such first and second random number seeds are identical, said first and second random numbers calculated by the terminal processors of said first and second gaming terminals will be identical.

17. The apparatus of claim 16 wherein said means for transmitting a series of random number seeds includes a processor in said central computer and a stored computer program.

18. Apparatus as claimed in claim 16 wherein said means in said first of said plurality of gaming terminals includes a processor and a stored computer program.

19. A method for using a gaming system comprising:

providing a central computer;

providing a plurality of gaming terminals;

transmitting a series of random number seeds from said central computer to each of said plurality of gaming terminals;

receiving a user input at least a first of said gaming terminals at a first time;

calculating a random number at said first gaming terminal based on one of said series of random number seeds wherein one of said random number seeds is selected by said first terminal on the basis of the time of its receipt relative to said first time.

20. A method for playing a poker style game comprising:

providing a central computer;

providing a plurality of electronic terminals, each of said plurality of electronic terminals including a microprocessor and a memory wherein said memory stores a program for playing a poker style game and a pay table for determining a win/loss result;

transmitting a plurality of random number seeds from said central computer to said electronic gaming terminal;

receiving a first user input at said first electronic terminal;

determining, in said first electronic terminal, whether the communication link between said first electronic terminal and said central computer is operable;

when said communication link is operable, calculating five deal random numbers in the range of 1–52 based on the next random number seed received from said central computer after said step of determining whether said communication link is operable;

displaying, on a display screen, coupled to said electronic terminal, images of five cards corresponding to said five random numbers;

receiving an indication of a wager from said user in said first electronic terminal;

receiving from said user an indication of cards which said user chooses to discard in said first electronic terminal;

determining whether said communication link is operable;

if said communication link is operable, calculating a number of draw random numbers equal to the number of cards selected as discard cards by said user in the range between 1–52, none of which are equal to said five deal random numbers to provide five hand random numbers based on the next seed received from said central computer after said step of determining whether said communication link is operable;

determining a win/loss result by comparing said five hand numbers to said pay table and outputting the result thereof.

21. A method for using the gaming system comprising:

providing a central computer means for selecting random number seeds which are determinative of winning symbols or combinations of symbols;

providing a plurality of electronic gaming terminals connected on-line to said central computer wherein said random number seeds are communicated from said central computer to said electronic terminals wherein the selection of random number seeds by said central computer is independent of any activation, play, or other manipulation by any user of an electronic terminal;

said electronic gaming terminal means incorporating a microprocessor that makes random selections of symbols for players, allows said players to make such selections, or draws symbols from a central repository which are communicated to such central computer and displays on a video screen winning symbols or combinations thereof wherein said electronic terminal does not select said winning symbols and wherein said winning symbols are determined on the basis of at least one random number seed communicated from said central computer to said electronic gaming terminal, said random number seed being one of a plurality of seeds transmitted from said central computer to said electronic terminal and when the decision regarding which of said plurality of random number seeds is used for determining said winning symbols is a function of when a user wagers or otherwise activates said electronic terminal.

* * * * *